US008852843B2

(12) United States Patent
Hirsch et al.

(10) Patent No.: US 8,852,843 B2
(45) Date of Patent: Oct. 7, 2014

(54) DISPENSING TONER ADDITIVES VIA CARRIER DISPENSE AND CLEAR TONER

(71) Applicant: Xerox Corporation, Norwalk, CT (US)

(72) Inventors: Mark J. Hirsch, Fairport, NY (US); Kip L. Jugle, Bloomfield, NY (US); John R. Falvo, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 157 days.

(21) Appl. No.: 13/669,740

(22) Filed: Nov. 6, 2012

(65) Prior Publication Data

US 2014/0127624 A1 May 8, 2014

(51) Int. Cl.
*G03G 9/10* (2006.01)

(52) U.S. Cl.
USPC ..... 430/137.21; 430/137.1

(58) Field of Classification Search
CPC .. G03G 9/0808; G03G 9/0815; G03G 9/0802
USPC ..... 430/137.1, 137.21
See application file for complete search history.

(56) References Cited

U.S. PATENT DOCUMENTS

| | | | |
|---|---|---|---|
| 3,467,634 | A | 9/1969 | Jacknow |
| 3,526,533 | A | 9/1970 | Jacknow et al. |
| 3,590,000 | A | 6/1971 | Palermiti |
| 3,800,588 | A | 4/1974 | Larson et al. |
| 3,847,604 | A | 11/1974 | Hagenbach et al. |
| 4,265,990 | A | 5/1981 | Stolka et al. |
| 4,558,108 | A | 12/1985 | Alexandru et al. |
| 4,935,326 | A | 6/1990 | Creatura et al. |
| 4,937,166 | A | 6/1990 | Creatura et al. |
| 5,082,761 | A | 1/1992 | Tasaka et al. |
| 5,569,572 | A | 10/1996 | Laing et al. |
| 7,805,099 | B2 | 9/2010 | Wayman et al. |
| 7,813,678 | B2 | 10/2010 | Wayman |
| 7,974,557 | B2 | 7/2011 | Wayman |
| 8,050,595 | B2 | 11/2011 | Wayman et al. |

FOREIGN PATENT DOCUMENTS

| | | |
|---|---|---|
| GB | 1442835 | 7/1976 |

*Primary Examiner* — Janis L Dote
(74) *Attorney, Agent, or Firm* — Fay Sharpe LLP

(57) ABSTRACT

A process is disclosed for the preparation of developer compositions comprising: providing a first developer including carrier and a first toner comprised of resin, pigment, polyolefin, a first compatibilizer, a first charge control agent, and a first metal oxide surface additive; and, adding thereto a second developer including carrier, and a second toner, second compatibilizer, a second charge control agent, and a second metal oxide surface additive.

13 Claims, 1 Drawing Sheet

OLD TONER PARTICLE. ADDITIVES HAVE BEEN BEATEN INTO SURFACE

FRESH TONER PARTICLE WITH SURFACE ADDITIVES

OLD TONER PARTICLE TWO MINUTES AFTER ADDITION OF FRESH TONER

OLD TONER PARTICLE 16 MINUTES AFTER ADDITION OF FRESH TONER

OLD TONER PARTICLE 48 MINUTES AFTER ADDITION OF FRESH TONER

DISPENSING TONER ADDITIVES VIA CARRIER DISPENSE AND CLEAR TONER

BACKGROUND

This disclosure relates to a set of electrophotographic toners which are used for electrophotographic machines such as electrostatic copying machines and laser printers.

In electrostatic copying machines (hereinafter referred to as copying machines) which utilize a binary developer comprising an electrophotographic toner (hereinafter referred to as a toner) and a carrier, an initial supply toner is contained together with a carrier in a developing apparatus from the beginning of the copying process, while a supplementary toner is contained in a toner hopper. The toner contained in the developing apparatus is mixed with the carrier in this apparatus, resulting in a developer. The developer formed in this way is supplied either to a photosensitive drum by magnetic rollers or to a donor roll, from which a toner layer is presented to a photosensitive drum. The toner contained in the toner hopper is supplied to the developing apparatus when a decrease in toner concentration in the developer contained in the developing apparatus is observed by a sensor for detecting toner concentration. Thereafter, the toner supplied to the developing apparatus is mixed with a carrier to form a developer which is then supplied to the photosensitive drum in the same way as mentioned above. The toner contained in the developer is adsorbed by an electrostatic latent image which has been formed on the photosensitive drum, and then transferred to paper, resulting in a desired toner image thereon.

The toner remaining on the surface of the photosensitive drum after the transfer to paper is scraped off the surface of the photosensitive drum by a cleaning blade in a cleaning apparatus.

In conventional copying machines, the supplementary toner contained in the toner hopper is the same as that contained in the developing apparatus from the beginning of the copying process. Usually, the toner mentioned above is composed of toner powder and additives adhering to the surface of the toner powder. This toner powder is obtained by mixing the material used, kneading the mixture, grinding the mixture into powder, and sizing the resulting powder to have a desired mean particle size. An alternative manufacturing method involves a chemical process to aggregate and coalesce smaller particles to form toner of the correct final size. As the additives to be used for the toner, there can be mentioned, for example, charge-controlling agents and cleaning agents.

The present disclosure is generally directed to toner and developer compositions, and more specifically, is directed to processes for controlling developer aging characteristics. In embodiments to be described hereinafter, the present disclosure relates to development wires in printing platforms that are sensitive to the state of the developer material. The state of the material can change or age over time. To mitigate the changes to the developer state, bare carrier can be added to the developer housing at a constant rate. This process is known as carrier dispense. Additionally, a minimum toner throughput can be established by writing patches in the interdocument area if necessary (i.e. MAC patch). While effective, both the carrier dispense and the MAC patches are costly.

It is known that dispensing small amounts of fresh toner can improve performance after extended runs of low area coverage. The benefit is due to the toner additives on the surface of the fresh toner.

The toner and developer compositions of the present disclosure, in embodiments thereof, provides for the attachment additives to the surface of clear toner particles. These clear toner particles can be mixed with carrier to form a developer and then can be dispensed into the housings via the existing carrier dispense system. The toner and developer compositions of the present disclosure can be selected for electrophotographic, especially xerographic imaging and printing processes, including color processes.

SUMMARY

To be described in more detail hereinafter, the present disclosure provides for the use of the surface area of clear toner particles as a vehicle to transport toner additives into a developer housing using an existing carrier dispense mechanism.

In one aspect of the present disclosure, a process is provided for the preparation of developer compositions comprising: providing a first developer including carrier and a first toner comprised of resin, pigment, polyolefin, a first compatibilizer, a first charge control agent, and a first metal oxide surface additive; and, adding thereto a second developer including carrier, and a second toner, second compatibilizer, a second charge control agent, and a second metal oxide surface additive.

DETAILED DESCRIPTION

Figure 1:
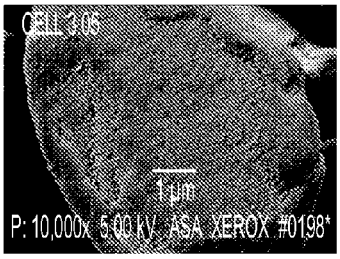
FIG. 1 is a scanned electron micrograph image of individual 'aged' toner particle wherein additives have been beaten into the surface.
Figure 2:
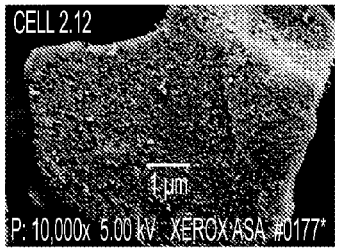
FIG. 2 is a scanned electron micrograph image of individual 'fresh' toner particle with surface additives.
Figure 3:
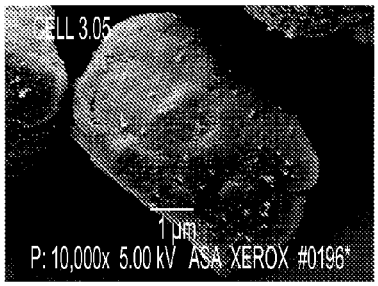
FIG. 3 is a scanned electron micrograph image of individual 'aged' toner particle two (2) minutes after addition of fresh toner.
Figure 4:
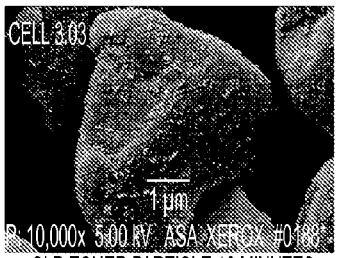
FIG. 4 is a scanned electron micrograph image of individual 'aged' toner particle sixteen (16) minutes after addition of fresh toner; and, FIG. 5 is a scanned electron micrograph image of individual 'aged' toner particle forty-eight (48) minutes after addition of fresh toner.
Figure 5:
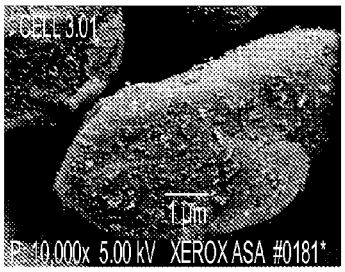

Extended runs of low area coverage increase the average time a toner particle spends in a housing. This allows the surface additives to become beaten or worn into the toner surface which ultimately reduces their effectiveness. In some printing platforms, this leads to a wire pollution problem in which small toner flats become highly charged and adhere to the HSD wires. This adherence to the wires causes non-uniform and low development. In other printing platforms the toner having altered additive state experiences changes in its adhesion to surfaces that reduce its development in the photosensitive drum or its transfer to paper. Currently, a combination of carrier dispense and MAC patch is used to mitigate this problem. In carrier dispense, a single reservoir of bare carrier is used to supply all four developer housings. A steady supply of fresh carrier reduces wire pollution, although the exact mechanism for its effectiveness is unclear. It is also known that toner additives are effective at reducing the effects of aged toner. Small amounts of fresh toner dispensed into a housing are able to share their additives among the entire sump and rejuvenate a developer state that was susceptible to wire pollution or other problems. MAC patch is a method to insure a minimum amount of toner throughout. However, it provides a required amount of fresh toner and additives when averaged over a period of time. For shorter time increments the toner throughout can be erratic.

Carrier dispense and MAC patch both use consumable materials (carrier and toner) and are thus costly remedies. Alternatively, one would like to dispense only the additives that are required to manage the wire pollution problem. However, additives are extremely small particles and are difficult to dispense in a controlled manner.

One embodiment proposed is to adhere toner additives to the surface of clear toner particles, mixed with carrier, and dispensed into developer housings via the carrier dispense system. Each developer housing would reach an equilibrium mixture of toners comprised of pigmented and clear toner.

Small toner particles provide a very large surface area to hold additives. It is to be appreciated that the necessary amount of additives to maintain developer health can be carried by a small amount of clear toner. This is important because the amount of clear toner dispensed should not dilute the color of the resulting mixed toner.

The amount of carrier dispensed, along with the amount of clear toner mixed with this carrier, and the concentration and type of toner additives on the clear toner can all be optimized for low run cost and image quality. The current carrier dispense system can be used and the rate of additive addition can be made uniform (i.e. constant rate). A uniform rate of addition can obviate the toner purge events used in systems heretofore cited. The uniform rate of addition enables the total amount of additives to be reduced because of the constant rate dispensing.

As described above, the surface of clear toner particles are used as a vehicle to transport toner additives into a developer housing using an existing carrier dispense mechanism. The vehicle provides for a method to dispense small toner additives in a controlled manner. The vehicle also provides an additive dispense rate that can be more uniform than methods heretofore implements. This results in achieving net cost reductions and/or image quality improvements by optimizing rates of carrier, clear toner, and additives.

The aforementioned provides a method of maintaining developer performance by dispensing toner surface additives blended with toner-like clear polymeric particles from the fresh carrier dispense system, where the carrier is pre-blended with these clear particles. The method results in a reduction in carrier consumption, and improved developer performance.

As mentioned above, the set of electrophotographic toners of this disclosure comprise an initial supply of toner particles and a supplementary supply of replenisher or developer particles, both of which comprise additives adhering to the surface of the particles. The weight ratio of the additives on the second (i.e. clear) toner can depend on the size of the second toner particles. The weight ratio can cover a range of surface area coverage from about 50% to about 100% of the second (i.e. clear) toner surface area.

Examples of additives which can be used are charge-controlling agents, cleaning agents, and the like. As a charge-controlling agent, fine powder can be used which is made of at least one material selected from the group consisting of hydrohobic silica, aluminum oxide, titanium oxide, zinc oxide, magnesium oxide, calcium carbonate, magnesium carbonate, magnesium hydroxide, barium sulphate, calcium sulphate, magnesium sulphate, and metal salts of fatty acids. As a cleaning agent, there can be used fine beads made of polystyrene or fine powder made of at least one material selected from the group consisting of polyfluoroethylene, zinc stearate, aluminum stearate, calcium stearate, and zinc laurate. Preferably, the fine bead or fine powder which is used for an additive such as a charge-controlling agent or a cleaning agent has a mean particle size of 2 μm or less.

The toner particles mentioned above can be prepared, for example, from the components: a colorant by which the resulting toner is colored; a resinous binder by which the colorant is fixed on paper; a charge-controlling agent which gives a desired degree of electrification to the resulting toner; and an anti-tack agent which prevents the resulting toner from adhering to fixing rollers.

Examples of resinous binders which can be used are polystyrene, styrene copolymers such as styrene-butadiene copolymers and styrene-acrylate copolymers, polyethylene, ethylene copolymers such as ethylene-vinyl acetate copolymers and ethylene-vinyl alcohol copolymers, phenol resins, epoxy resins, diallyl phthalate resins, polyamide resins, polyester resins, and maleic resins.

Examples of colorants which can be used are carbon black, nigrosines, aniline black, chalco oil blue, chrome yellow, ultramarine yellow, methylene blue, du Pont oil red, quinoline yellow, methylene blue chloride, phthalocyanine blue, malachite green, oxalate, lampblack, rose bengal, and mixtures thereof. The toner powder should contain a sufficient amount of colorant to form a distinct toner image.

Examples of charge-controlling agents which can be used are amino compounds, quaternary ammonium salts such as N-benzy-N,N-dimethyl-N-hexadecylammonium chloride and N-decyl-N,N,N-trimethylammonium chloride, and organic dyes, particularly basic dyes and salts thereof such as nigrosine, nigrosine hydrochloride, safranine, and crystal violet. Among these, nigrosine and nigrosine hydrochloride are sometimes used as a positive-charge controlling agent.

Examples of anti-tack agents which can be used are polypropylene, polyethylene, and paraffin wax. When used individually to prepare the toner, these anti-tack agents are quite useful in providing the improved release of the toner from the fixing rollers.

These and other objects of the present disclosure can be accomplished in embodiments thereof by providing toner compositions comprised of resin particles, and pigment particles, developer compositions thereof, and processes thereof. In embodiments, the present disclosure is directed to a process for the preparation of developer compositions comprising providing a first developer comprised of carrier and toner comprised of resin, pigment, a polyolefin, a polyolefin wax, compatibilizer, charge control agent, and surface additive, and adding thereto a second replenisher developer comprised of carrier, compatibilizer, charge control agent, and surface additive.

Illustrative examples of suitable toner resins selected for the toner, developer compositions and processes of the present disclosure include thermoplastics such as polyamides, polyolefins, styrene acrylates, styrene methacrylates, styrene butadienes, crosslinked styrenes, polyesters including extruded crosslinked polyesters, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like. Examples of specific resins include styrene butadiene copolymers with a styrene content of from about 70 to about 95 weight percent; the esterification products of a dicarboxylic acid and a diol comprising a diphenol as illustrated in U.S. Pat. No. 3,590,000, the disclosure of which is totally incorporated herein by reference. Other specific toner resins include styrene/methacrylate copolymers, and styrene/butadiene copolymers; PLIOLITES®; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethyl terephthalate, 1,3-butanediol, 1,2-propanediol, and pentaerythritol, styrene acrylates, and mixtures thereof. Also, polyolefins with a molecular weight $M_w$ from about 1,000 to about 10,000, such as polyethylene, polypropylene, and paraffin polyolefins, can be included in, or on the toner compositions as fuser roll release agents.

Numerous well known suitable pigments or dyes can be selected as the colorant for the toner particles including, for example, carbon black, nigrosine dye, aniline blue, magnetite, or mixtures thereof. The pigment should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected providing the objectives of the present disclosure are achieved.

The toner surface additive can be a metal oxide such as aluminum oxides, cerium oxides, titanium dioxides, silicon oxides, especially fumed silicas, and the like. Titanium dioxide is one exemplary surface additive and is present in the amounts indicated herein.

There can also be blended with the toner compositions of the present disclosure external additive particles including flow aid additives, which additives are usually present on the surface thereof. Examples of these additives include fumed silicas such as AEROSIL™, metal salts and metal salts of fatty acids inclusive of zinc stearate, and the like, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

Also, there can be included in the toner compositions low molecular weight polyolefins, such as polypropylenes, polyethylenes, or mixtures thereof, for example from 10 to 90 and 90 to 10 of the first and second polyolefins, respectively, commercially available from Allied Chemical and Petrolite Corporation, EPOLENE N-15™, commercially available from Eastman Chemical Products, Inc., VISCOL 550-P™, a low weight average molecular weight polypropylene available from Sanyo Kasei K. K., 800P and P200 polyolefins from Mitsui Chemical Corporation, and the like. The commercially available polyethylenes selected have a weight average molecular weight of from about 1,000 to about 1,500, while the commercially available polypropylenes utilized for the toner compositions of the present disclosure are believed to have a weight average molecular weight of from about 4,000 to about 5,000. Many of the polyethylene and polypropylene compositions useful in the present disclosure are illustrated in British Patent No. 1,442,835, the disclosure of which is totally incorporated herein by reference.

Known charge additives can be selected for the toner in effective amounts, such as from about 0.5 to about 3 weight percent, examples of the additives including those as illustrated in the patents mentioned herein, P51, available from Orient Chemicals of Japan, and the like.

For the formulation of developer compositions, there are mixed with the toner particles carrier components, particularly those that are capable of triboelectrically assuming an opposite polarity to that of the toner composition. Accordingly, the carrier particles of the present disclosure can be selected to be of a positive polarity enabling the toner particles, which are negatively charged, to adhere to and surround the carrier particles. Illustrative examples of carrier particles include iron powder, steel, nickel, iron, ferrites, including copper zinc ferrites, magnetites, which are preferred, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,935,326 and 4,937,166, the disclosures of which are totally incorporated herein by reference, including, for example, KYNAR® and polymethylmethacrylate mixtures. Coating weights can vary as indicated herein; generally, however, from about 0.3 to about 2 and preferably from about 0.5 to about 1.5 weight percent coating weight is selected. Carrier coatings with a conductive component, such as carbon black, in an amount of from about 20 to about 40 percent can also be selected.

Furthermore, the diameter of the carrier particles, preferably approximately spherical in shape, is generally from about 3 microns to about 300 and preferably from about 20 to about 90 microns thereby permitting them to possess sufficient density and inertia to avoid adherence to the electrostatic images during the development process. The carrier component can be mixed with the toner composition in various suitable combinations, such as about 1 to 10 parts per toner to about 100 parts to about 200 parts by weight of carrier.

The toner and developer compositions of the present disclosure may be selected for use in electrostatographic imaging apparatuses containing therein conventional photoreceptors providing that they are capable of being charged negatively. Thus, the toner and developer compositions of the present disclosure can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed:

1. A process for the preparation of developer compositions comprising providing a first developer comprised of carrier and a first toner comprised of resin, pigment, polyolefin, a first compatibilizer, a first charge control agent, and a first metal oxide surface additive, and adding thereto a second developer comprised of carrier and a second clear toner comprised of a second compatibilizer, a second charge control agent, and a second metal oxide surface additive.

2. A process in accordance with claim 1, wherein the first surface additive for the first developer is titanium dioxide.

3. A process in accordance with claim 1, wherein the first surface additive for the first developer is present in an amount of from about 0.1 percent by weight to about 5.0 percent by weight of the first toner.

4. A process in accordance with claim 3, wherein the second surface additive for the second developer is present in an amount of from about 0.1 percent by weight to about 5.0 percent by weight of the second toner.

5. A process in accordance with claim 1, wherein the second developer is added at a constant rate.

6. A process in accordance with claim 1 wherein the first charge control agent is present in an amount of from about 0.50 to about 3.0 weight percent in the first toner.

7. A process in accordance with claim 6 wherein the second metal oxide surface additive for the second developer is present in an amount of 0.1 to 5.0 weight percent of the second toner.

8. A process for the preparation of developer compositions comprising:

providing a first developer comprised of carrier and a first toner comprised of resin, pigment, polyolefin, a first compatibilizer, a first charge control agent, and a first metal oxide surface additive;

adding thereto a second developer comprised of carrier and a second clear toner comprised of a second compatibilizer, a second charge control agent, and a second metal oxide surface additive; and, wherein said second metal oxide surface additive includes a range of surface area coverage from about 50% to about 100% of said second clear toner surface area.

9. A process in accordance with claim 8, wherein the first surface additive for the first developer is titanium dioxide.

10. A process in accordance with claim 9, wherein the second surface additive for the second developer is present in an amount of from about 0.1 percent by weight to about 5.0 percent by weight of the second toner.

11. A process in accordance with claim 10, wherein the second developer is added at a constant rate.

12. A process in accordance with claim 8, wherein the first charge control agent is present in an amount of from about 0.5 to about 3.0 weight percent in the first toner.

13. A process in accordance with claim 12, wherein the second metal oxide surface additive for the second developer is present in an amount of 0.1 to 5.0 weight percent of the second toner.

* * * * *